United States Patent [19]

Huffey et al.

[11] 4,293,633

[45] Oct. 6, 1981

[54] REFLEX COPYING PROCESS ONTO LIGHT-SENSITIVE RECORDING MATERIALS

[75] Inventors: Roy F. Huffey, Manningtree; John A. Pope, Colchester, both of England

[73] Assignee: Bexford Limited, London, England

[21] Appl. No.: 96,648

[22] Filed: Nov. 23, 1979

[30] Foreign Application Priority Data

Dec. 11, 1978 [GB] United Kingdom ..... 47952/78

[51] Int. Cl.[3] ..... G03C 5/10; G03C 5/20

[52] U.S. Cl. ..... 430/152; 430/395; 430/396

[58] Field of Search ..... 430/152, 395, 396

[56] References Cited

U.S. PATENT DOCUMENTS

| | | | |
|---|---|---|---|
| 2,051,584 | 8/1936 | Van der Grinten | 430/395 |
| 2,051,585 | 8/1936 | Van der Grinten | 430/395 |
| 3,924,946 | 12/1975 | Meyer et al. | 430/152 |

*Primary Examiner*—John D. Welsh

*Attorney, Agent, or Firm*—Cushman, Darby & Cushman

[57] ABSTRACT

Reflex copying of original materials, normally having an opaque background, onto light-sensitive vesicular imaging materials wherein exposure to light is effected through a screen which transmits the incident light in separate bundles of light rays.

7 Claims, 5 Drawing Figures

2.0
1.5
1.0
0.5
0
IMAGE CONTRAST ($D_{max}-D_{min}$)
90%
80%
70%
0
50
100
150
200
250
300
EXPOSURE TIME - SECONDS 2.0
1.5
1.0
0.5
0
IMAGE CONTRAST ($D_{max} - D_{min}$)
90%
80%
0
50
100
150
200
250
300
EXPOSURE TIME – SECONDS 2.0
1.5
1.0
0.5
0
IMAGE CONTRAST ($D_{max}$ - $D_{min}$)
90%
80%
0
50
100
150
200
250
300
EXPOSURE TIME-SECONDS

REFLEX COPYING PROCESS ONTO LIGHT-SENSITIVE RECORDING MATERIALS

The present invention relates to a copying process for recording an image upon a light-sensitive imaging material by reflex imaging techniques.

Reflex imaging processes are known in the art for the copying of original material held against an opaque background and in particular opaque originals such as information printed or written upon opaque paper. Copying is generally accomplished by holding the original material in contact with the light-sensitive imaging material and exposing the assembly to light incident through the light-sensitive imaging material. An image is recorded in the light-sensitive imaging material by light reflected by the original material. British patent specification 425,126 describes a reflex imaging process for copying onto light-sensitive diazotype materials in which a screen is interposed between the light source and the light-sensitive diazotype material and serves to split the incident light into bundles of rays such that the whole area of the light-sensitive diazotype material is not exposed to the incident light thereby minimising loss of contrast in the image recorded in the diazotype material. However, the maximum projection density ($D_{max}$ as hereinafter defined) of images which can be recorded upon diazotype materials by reflex copying using a gradated screen is unacceptably poor and is reduced dramatically in comparison with values obtainable by normal transmission copying and the true maximum density of which the diazotype material is capable. Furthermore, greater maximum projection densities are only recorded upon diazotype materials using gradated screens which do not transmit a major proportion of the incident light, e.g. screens which stop 90% of the incident light, with the result that exceptionally long exposure times become necessary, e.g. in the range 10 to 15 minutes. As a result, reflux copying onto light-sensitive diazotype materials even by means of a screen is impracticable.

Reflex imaging processes have also been proposed, e.g. in British Pat. Nos. 850,954 and 1,467,774 and U.S. Pat. No. 3,194,659 and 3,194,660, for recording images upon light-sensitive vesicular imaging materials. The images recorded by the processes described therein are of poor quality on account of the exposure of the light-sensitive vesicular material by the incident light. There has however been no proposal to reflex image such materials by means of a screen which transmits light as a multiplicity of bundles of light rays.

Applicants have surprisingly discovered that light-sensitive vesicular materials can be imaged by a reflex process using a screen and that, unlike similar processes involving diazotype materials, recorded images of acceptable quality, e.g. high maximum projection density, can be obtained with acceptably short exposure times.

According to the present invention a copying process comprises recording an image of an original material upon a light-sensitive vesicular imaging material by reflex exposure to imaging light, said light-sensitive vesicular imaging material having an imaging layer comprising a polymeric vehicle which is softenable upon heating above ambient temperature to permit the formation of a recorded image in the form of light-scattering or reflecting gas vesicles in those areas struck by imaging light, wherein a screen is interposed between the source of imaging light and the light-sensitive vesicular imaging material, said screen transmitting the light incident from the source of imaging light in separate bundles of light rays, the light-sensitive vesicular imaging material is reflex imaged by means of the bundles of light rays transmitted through the light-sensitive vesicular imaging material and reflected from the original material, and the light-sensitive vesicular imaging material is heated to soften the polymeric vehicle to permit the formation of a recorded image in the form of gas vesicles.

Certain terms employed throughout this specification have the following meaning:

"$D_{max}$" (maximum projection density) relates to the densest image which can be produced in a processed material, the values quoted hereinafter being measured by a Macbeth densitometer TD 528 at an aperture of f4.5 using a Wratten 106 filter.

"$D_{min}$" relates to the lowest density which can be obtained in a processed material, the values quoted hereinafter being measured by a Macbeth densitometer TD 528 at an aperture of f4.5 using a Wratten 106 filter.

"Nitrogen permeability constant" refers to the volume of nitrogen in $cm^3$ which diffuses in one second through one cm of a sample of the polymeric vehicle, one $cm^2$ in area, and under a pressure gradient of one cm of mercury at a constant temperature of 25° C.

"Ambient temperature" relates to temperatures of at least 20° C.

Light-sensitive vesicular imaging materials are known in the art and are described in British Pat. Nos. 850,954 and 1,467,774 and U.S. Pat. Nos. 3,194,659 and 3,194,660 mentioned above and British patent specification 861,250 and generally comprise a film or sheet support carrying an imaging layer comprising a thermoplastics polymeric vehicle and a sensitising agent dispersed through the vehicle. The sensitising agent is decomposable on exposure to actinic light to evolve a gas such as nitrogen thereby forming a latent gas image in the vehicle. Generally, the latent image is developed by heating the material, usually above the softening temperature of the polymeric vehicle, to enable the gas in the light-struck areas to expand into bubbles or vesicles which have a light-scattering or reflecting activity. Any of the known light-sensitive imaging materials are suitable for imaging by the copying process according to the invention.

The light-sensitive vesicular imaging materials employed in the process according to the present invention preferably comprise an imaging layer applied to a transparent self-supporting plastics sheet or film which may consist of any suitable plastics material, which may optionally be coloured by means of a dye, such as cellulose esters, e.g. cellulose acetate, or thermoplastics, such as polystyrene, polyamides, polymers and copolymers of vinyl chloride, polycarbonate, polymers and copolymers of olefines, e.g. polyethylene and polypropylene, polysulphones and linear polyesters which may be obtained by condensing one or more dicarboxylic acids or their lower alkyl diesters, e.g. terephthalic acid, isophthalic, phthalic, 2,5-, 2,6- and 2,7-naphthalene dicarboxylic acid, succinic acid, sebacic acid, adipic acid, azelaic acid, diphenyl dicarboxylic acid, and hexahydroterephthalic acid or bis-p-carboxyl phenoxy ethane, optionally with a monocarboxylic acid, such as pivalic acid, with one or more glycols, e.g. ethylene glycol, 1,3-propanediol, 1,4-butanediol, neopentyl glycol and 1,4-cyclohexanedimethanol. Biaxially oriented and heat-set films of polyethylene terephthalate are particularly useful according to this invention.

The polymeric vehicle of the imaging layer may comprise any of the thermoplastic polymers known in the art for use in vesicular imaging layers and having properties such that light-scattering or reflecting vesicles can be formed therein. Suitable polymeric vehicles include polymers of vinylidene chloride as described in British patent specification 861,250 and the polymers described in British Pat. Nos. 1,272,894, 1,276,608, 1,278,004, 1,312,573, 1,330,344, 1,352,559, 1,352,560 and 1,400,245.

The imaging layer may optionally include any of the known additives such as surfactants and stabilising acids.

The sensitising agent incorporated into the vehicle may comprise any of the sensitising agents known in the vesicular art and should be non-reactive with the vehicle. Likewise the vesicle-forming gas which is liberated by the sensitising agent should be non-reactive with the vehicle. The preferred sensitising agents are those which liberate nitrogen on exposure to actinic light, especially ultraviolet light which is widely used in vesicular processing equipment, suitable agents including nitrogen-liberating diazonium salts, such as those which may be derived from the following amines:

N,N-dimethyl-p-phenylenediamine
N,N-diethyl-p-phenylenediamine
N,N-dipropyl-p-phenylenediamine
N-ethyl-N-$\beta$-hydroxyethyl-p-phenylenediamine
N,N-dibenzyl-3-ethoxy-4p-phenylenediamine
4-N-morpholino-aniline
2,5-diethoxy-4-N-morpholino-aniline
2,5-dimethoxy-4-N-morpholino-aniline
2,5-di-(n-butoxy)-4-N-morpholino-aniline
4-N-pyrrolidino-aniline
3-methyl-4-N-pyrrolidino-aniline
3-methoxy-4-N-pyrrolidino-aniline
2-ethoxy-4-N,N-diethylamino-aniline
2,5-diethoxy-4-benzoylamino-aniline
2,5-diethoxy-4-thio-(4'-tolyl)-aniline Other suitable sensitising agents include quinonediazides and especially that having the structure:

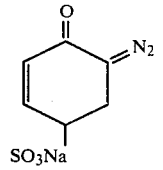

and azide compounds derived from the structure:

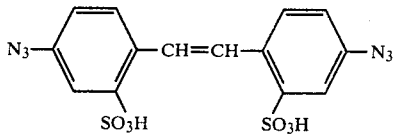

Alternatively, carbazido compounds (carboxylic acid azides) containing a hydroxyl or amino group in the position ortho to the carbazido group may be used.

Optimum image formation and vesiculation is obtained in plastics vehicles which include nitrogen-liberating sensitising agents when the thermoplastics component has a nitrogen permeability constant in the range $1\times10^{-15}$ to $1\times10^{-10}$.

Alternatively, other known sensitising agents which liberate gases other than nitrogen may be employed, e.g. those agents described in British Pat. No. 1,359,086 and U.S. Pat. No. 3,549,376.

The light-sensitive vesicular imaging material may be produced by applying the imaging layer to the plastics sheet or film as a solution in any suitable common organic solvent, such as butan-2-one, toluene and methanol, by any of the means known in the art for coating light-sensitive imaging layers.

The imaging layer may optionally be treated with an aqueous solution of steam or water vapour to reduce its contrast or photographic gamma by techniques which are already established in the art, e.g. as described in U.S. Pat. No. 3,149,971.

If desired, the surface of the plastics sheet or film may be pretreated and/or coated with an adhesion-promoting layer prior to the application of the imaging layer. Polyethylene terephthalate film carriers may be pretreated by coating with solutions of materials having a solvent or swelling action on the film such as halogenated phenols in common organic solvents, e.g. solutions of p-chloro-m-cresol, 2,4-dichlorophenol, 2,4,6- or 2,4,5-trichlorophenol or 4-chlororesorcinol or a mixture of such materials in acetone or methanol. After application of such a solution the film surface can be dried and heated at an elevated temperature for a few minutes, e.g. 2 minutes at 60° to 100° C. If desired, the pretreating solution may also contain an adhesion-promoting polymer such as a partially hydrolysed copolymer of vinyl chloride and vinyl acetate.

As an alternative to, or in addition to, such a pretreatment, a material having a swelling or solvent action upon the film may be incorporated into the coating composition applied to the film.

The screen employed according to this invention is such that the incident imaging light is transmitted as separate bundles of light rays. As a result incident light transmitted by the light-sensitive vesicular imaging material can only have any influence upon the imaging layer in those areas traversed by bundles of light rays. The remaining areas of the imaging layer are therefore available for recording the image by means of light reflected from the original material and the quality of the recorded image in those areas cannot be affected by the passage of the bundles of incident light through the imaging layer.

Screens adapted to transmit the incident light as bundles of rays by optical means, i.e. screens having a lenticular or prismatic structure, may be employed according to this invention but it is preferred to use gradated screen which preferentially masks a proportion of the total area of the imaging material so that light incident upon the masked regions of the screen is partially or more preferably substantially completely absorbed. It will be appreciated that the sensitising agent in the regions of the imaging layer which transmit the incident bundles of light rays is partially or completely decomposed by the incident light. These areas therefore form a spurious image which is superimposed on the true recorded image formed by the reflection of light from the original material. The distortion of the true recorded image by the spurious image diminishes as the proportion of the total area of the screen which is unmasked and is capable of transmitting bundles of incident light diminishes. Furthermore, the distortion will also be determined by the dimensions of the unmasked areas of the screen in relation to the detail, e.g. the size of printed characters, in the original material being copied.

Particularly suitable gradated screens for use according to this invention may include a regular pattern of light-transmitting or masking dots consisting of regularly spaced apart parallel lines of dots intersected perpendicularly by similarly regularly spaced apart parallel lines of dots. Such screens are commercially available (e.g. from Policrom Photo Products SpA) and have line spacings of 25, 40, 48, 54 and 60 lines per cm with line gradations representing the percentage area of the screen which is masked and non-light transmitting in the range 10 to 90%.

In practice the line spacing of the screen should be fine enough to reproduce a recorded image having the detailed information of the original without serious distortion as a result of masking by the screen in the imaged areas. It is generally preferred to employ screens having 40 or more lines per cm, the greater number of lines having a greater capacity for recording image detail. Screens having 54 or 60 lines per cm are especially preferred.

Exposure times are influenced by the area of such gradated screens which is unmasked and hence capable of transmitting incident light and increase for higher precentage gradations. On the other hand, exposure latitude for a chosen recorded image contrast determined as ($D_{max}$ to $D_{min}$) increases with higher percentage gradations, i.e. screens having greater masked non-light transmitting areas. The influence of percentage gradation upon exposure times and exposure latitude is illustrated by FIGS. 3, 4 and 5 which are described in greater detail hereinafter. It is generally preferred to use screens having a non-light transmitting gradation of at least 80%.

Whilst it is possible to incorporate the screen as an integral member of the light-sensitive vesicular imaging material, it is preferred and generally more convenient to employ the screen and imaging material as separate components.

The copying process is preferably accomplished by uniting in mutual contact the original material, the light-sensitive vesicular imaging material and the screen and exposing by a conventional technique in a pressure or vacuum frame.

The latent gas image formed in the imaging layer upon exposure to light may be developed in a conventional manner by heating immediately after light exposure to soften the polymeric vehicle thereby permitting the gas vesicles to form in the light-struck areas. Fixing may then be accomplished by a further overall light exposure and permitting the gas evolved by the decomposition of the sensitising agent as a result of the second exposure to diffuse out of the imaging layer.

Another aspect of the invention relates to the imaged material carrying the image of the original material recorded by copying process described above.

The imaged materials are suitable for use as transparency masters for optical projection and especially for overhead projection techniques. It is preferred that image materials for use as transparencies in this manner should have the opposite sense from the original material, i.e. the image is developed by heating immediately after light exposure, since an image of a normal original, i.e. black characters on a white background, is projected with a black background does not therefore give rise to glare as often occurs when black characters are projected on a white background.

Coloured effects may be produced by using a dyed supporting film or sheet or alternatively by the deposition of a dyed layer upon the imaging material or including a dye in the imaging layer. The dye may, if desired, be transparent until the heating step employed to develop the recorded image, the colouration of the dye being produced during heating.

A preferred embodiment of the invention is described below with reference to the accompanying drawings, in which.

Figure 1:
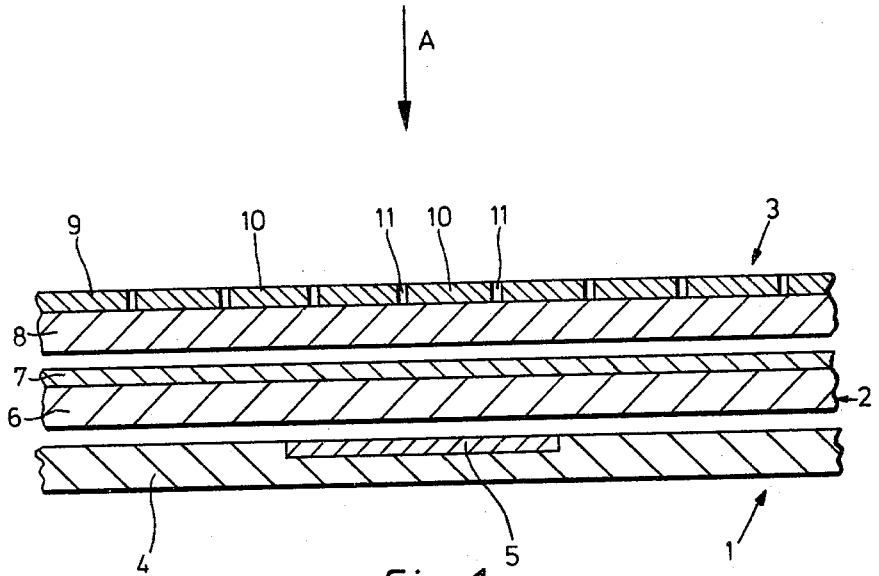
FIG. 1 is a cross-sectional view of an original material, a light-sensitive vesicular imaging material and a screen for use in a preferred copying process according to the invention.

FIG. 1 illustrates an original material 1, a light-sensitive vesicular imaging material 2 and a screen 3, which are shown slightly spaced apart to facilitate illustration. In practice the materials are held in firm interfacial contact during the copying process. The original material consists of an opaque white paper sheet 4 carrying a black ink notation 5. The light-sensitive vesicular imaging material 2 comprises any conventional commercially available vesicular imaging material, such as that marketed by Bexford Limited under code VP61, and has a thick biaxially oriented and heat-set transparent polyethylene terephthalate film 6 carrying an imaging layer 7 which includes a thermally softenable polymeric vehicle and a sensitising agent. The screen 3 comprises a thermally stable transparent plastics film support 8 having deposited thereon a screening layer 9 which may comprise a photographic silver image. The screening layer 9 has regions 10 which absorb light incident thereon whilst light can be transmitted through the intervening unscreened regions 11.

Copying is effected by exposing the assembly illustrated in FIG. 1 to ultra-violet light incident from a source emitting parallel light rays in the direction of the arrow A. Light incident upon the regions 10 of the screen 3 is absorbed and does not penetrate to image the imaging layer 7 of the imaging material 2. Light incident upon the unscreened regions 11 of the screen 3 traverses the screen 3 and in the initial stages of the exposure is to a large extent absorbed by the sensitising agent in those regions of the imaging layer 7 immediately beneath the unscreened regions 11. As the exposure time and the decomposition of the sensitising agent in the imaging layer 7 progresses, the ultra-violet light passing through the unscreened regions 11 of the screen is able to penetrate the imaging material 2 to impinge upon the original material 1. Light incident upon the black ink notation 5 of the original material 1 is absorbed whereas light incident upon the surrounding white area 4 is reflected and forms a latent image in the imaging material 2 by the decomposition of the sensitising agent in the corresponding light-struck area of the imaging layer 7.

Figure 2:
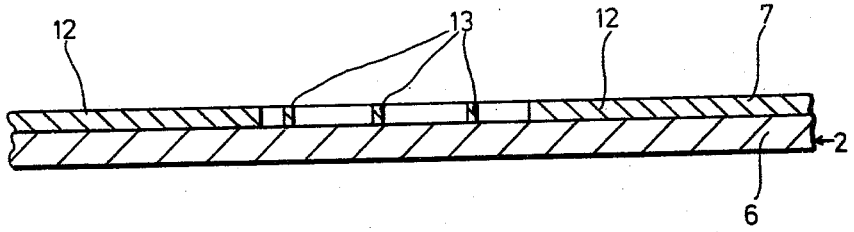
FIG. 2 is a cross-sectional view of the light-sensitive vesicular imaging material illustrated in FIG. 1 and bearing an image of the original material.

When the exposure of the assembly is complete, the light-sensitive vesicular imaging material 2 is immediately heated to a temperature above the softening temperature of the imaging layer 7 to enable the latent gas formed by the decomposition of the sensitising agent in the light-struck regions of the imaging layer 7 to expand into imaging bubbles or vesicles. The resulting copy is illustrated in FIG. 2 wherein the imaging bubbles or vesicles are formed in the cross-hatched regions. The image of the white area 4 of the original material 1 is represented by the reference numeral 12 whilst a spurious image of the unscreened regions 11 of the screen 3 which arises from the passage of incident light through those parts of the imaging layer 7 is represented by the reference numeral 13.

Figure 3:
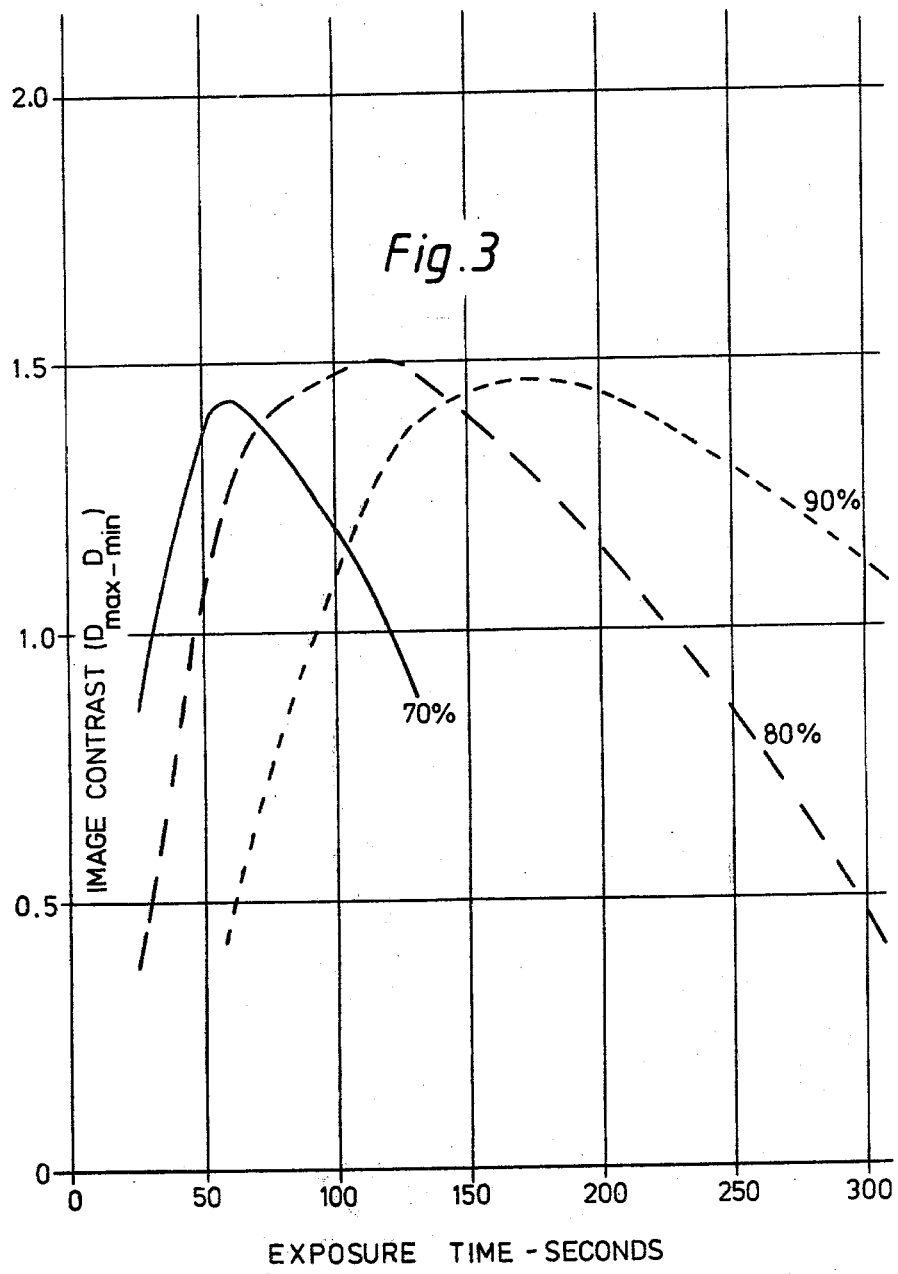
FIGS. 3 to 5 are graphs which record the relationship between exposure time and image contrast determined using different screens in the process described with reference to FIGS. 1 and 2.
Figure 4:
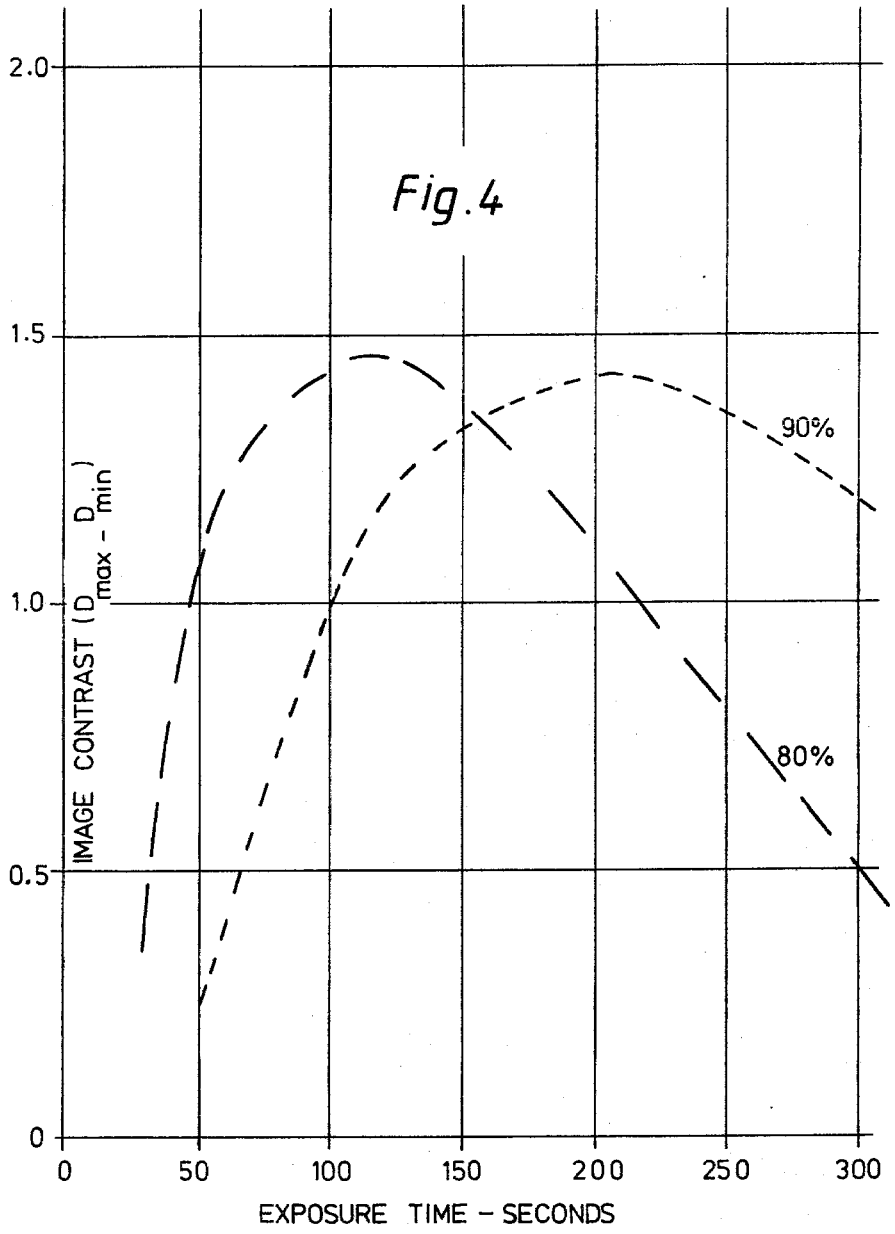
Figure 5:
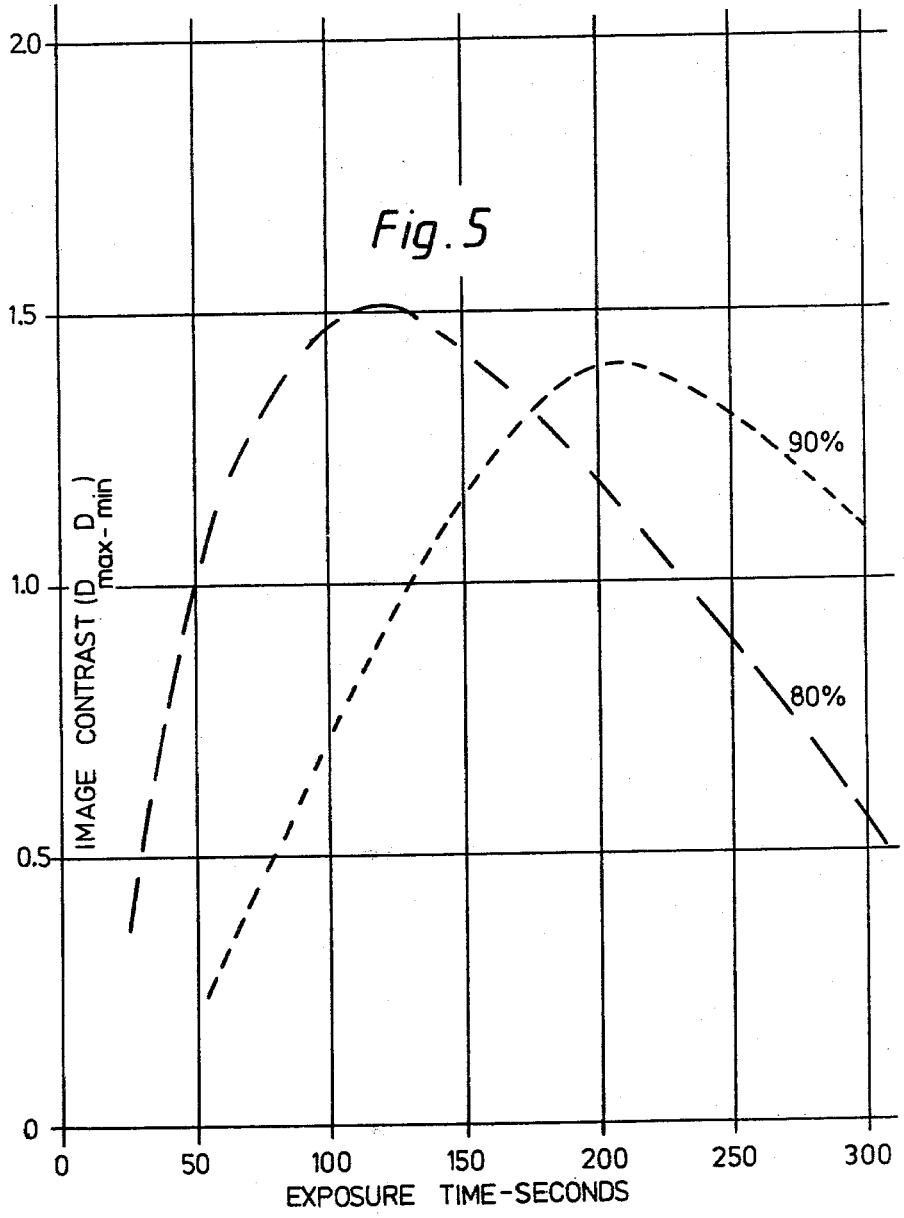

FIGS. 3, 4 and 5 are graphs relating to exposure tests carried out according to the procedure described with reference to FIGS. 1 and 2. The exposure tests were conducted with the vesicular imaging material marketed by Bexford Limited under code VP61 which has a maximum projection density $D_{max}$ of 2.35 when exposed non-imagewise to ultra-violet light and in the absence of a screen and immediately processed by heating for 1 to 2 seconds at 120° C.

A series of image copies were produced at various exposure times using screens commercially available from Policrom Photo Products SpA, the image contrast being determined from $D_{max}$ and $D_{min}$ measurements and plotted as graphs in FIGS. 3, 4 and 5. The screens employed were as follows:

FIG. 3—60 lines per cm, 70%, 80% and 90% gradations,

FIG. 4—54 lines per cm, 80% and 90% gradations, and

FIG. 5—48 lines per cm, 80% and 90% gradations.

It will be seen that the maximum image contrast obtainable is not significantly influenced by the nature of the screen, being of the order of 1.4 to 1.5. Screens having higher gradations exhibit greater latitude in exposure times and this is particularly pronounced at image contrasts close to the maximum contrast obtainable with a 60 lines per cm screen.

We claim:

1. A copying process for recording an image of an original material upon a light-sensitive vesicular imaging material by reflex exposure to imaging light, the light-sensitive vesicular imaging material having an imaging layer comprising a polymeric vehicle which is softenable upon heating above ambient temperature to permit the formation of a recorded image in the form of light-scattering or reflecting gas vesicles in those areas struck by imaging light, said process comprising the steps of:

selecting a screen;

interposing the screen between the source of imaging light and the light-sensitive vesicular imaging material, the screen transmitting the light incident from the source of imaging light in separate bundles of light rays;

reflex imaging the light-sensitive vesicular imaging material by means of the bundles of light rays transmitted through the light-sensitive vesicular imaging material and reflected from the original material and;

softening the polymeric vehicle of the light-sensitive vesicular imaging material by heating said vesicular imaging material to record an image of the original material in the form of gas vesicles in the imaging layer.

2. An imaged light-sensitive vesicular imaging material carrying an image recorded by the copying process according to claim 1.

3. A process as recited in claim 1 where said screen-selecting step is accomplished by selecting a screen having a lenticular or prismatic structure.

4. A process as recited in claim 1 wherein said screen-selecting step is practiced by selecting a screen which is graduated and preferentially masks a portion of the total area of the imaging material so that light incident upon the masked regions of the screen is partially or substantially completely absorbed.

5. A process as recited in claim 1 wherein said screen-selecting step is practiced by selecting a screen which is graduated, comprising a regular pattern of light-transmitting or masking dots comprising regularly spaced apart parallel lines of dots intersected perpendicularly by similarly regular spaced apart parallel lines of dots, preferentially masking a proportion of the total area of the imaging material so that light incident upon the masked region of the screen is partially or substantially completely absorbed.

6. A process as recited in claim 1 wherein said screen-selecting step is accomplished by selecting a screen which is graduated, comprising a regular pattern of light-transmitting or masking dots comprising regularly spaced apart parallel lines of dots intersected perpendicularly by similarly regularly spaced apart parallel lines of dots providing a line spacing of 25, 40, 48, 54, or 60 lines per centimeter and a masked graduation area in the range of 10 to 90 percent, the screen preferentially masking a proportion of the total area of the imaging material so that light incident upon the masked regions of the screen is partially or substantially completely absorbed.

7. A process as recited in claim 1 wherein said screen-selecting step is accomplished by selecting a screen which is graduated, comprising a regular pattern of light-transmitting or masking dots comprising regularly spaced apart parallel lines of dots intersected perpendicularly by similarly regularly spaced apart parallel lines of dots providing a line spacing of 25, 40, 48, 54, or 60 lines per centimeter and a masked graduation area in the range of at least 80 percent, the screen preferentially masking a proportion of the total area of the imaging material so that light incident upon the masked regions of the screen is partially or substantially completely absorbed.

* * * * *